US005582041A

United States Patent [19]

Spiess

[11] Patent Number: 5,582,041

[45] Date of Patent: Dec. 10, 1996

[54] PORTABLE HAND-HELD FLESHING TOOL

[76] Inventor: David E. Spiess, 6213 Comite Dr., Baker, La. 70714

[21] Appl. No.: 529,748

[22] Filed: Sep. 18, 1995

[51] Int. Cl.[6] ..... C14B 19/00

[52] U.S. Cl. ..... 69/37; 69/20; 30/276

[58] Field of Search ..... 69/37, 39, 40, 69/46, 20, 21; 30/276, 272.1, 277.4, 390

[56] References Cited

U.S. PATENT DOCUMENTS

| | | | |
|---|---|---|---|
| 1,382,126 | 6/1921 | Schroedter et al. . | |
| 1,631,366 | 6/1927 | Feister . | |
| 2,480,994 | 9/1949 | Alberti | 69/20 |
| 2,492,534 | 12/1949 | Porteous | 6.9/20 |
| 2,518,939 | 8/1950 | Ross | 30/167 |
| 2,847,845 | 8/1958 | Frank et al. | 69/20 |
| 3,266,535 | 8/1966 | Brodie | 143/155 |
| 3,852,882 | 12/1974 | Bettcher | 30/276 |
| 4,858,321 | 8/1989 | McCullough | 30/276 |
| 4,892,022 | 1/1990 | Cotton et al. | 30/390 |
| 4,972,586 | 11/1990 | Matsumoto et al. | 30/276 |
| 4,993,243 | 2/1991 | Guinn | 69/37 |
| 5,031,325 | 7/1991 | Walter et al. | 30/390 |

FOREIGN PATENT DOCUMENTS 3113253 10/1982 Germany .

OTHER PUBLICATIONS

Taxidermy Today–Summer 1995, p. 27, Guinn's Taxidermy, Inc. "Flesh–All Miniflesher".

Taxidermy Today–Summer 1995, p. 42, Hionis Taxidermy Wholesale Supplies, "The Friendly Flesher".

Taxidermy Today–Summer 1995, p. 51, Authentic Supplies by James Edgar, "The Portable Flesher".

Taxidermy Today–Summer 1995, p. 57, Van Dyke's Supply, "Hardest Fleshing Blade on the Market".

Taxidermy Today–Summer 1995, p. 70, Dixiland Taxidermy Supply, "Capps Fleshing Machines at Dixieland".

Breakthrough, Issue 40, Spring 1995, p. 15, Guinn's Taxidermy, Inc., "Flesh–All".

Breakthrough, Issue 40, Spring 1995, p. 92, Authentic Taxidermy & Supply, "Fleshing Machine".

Breakthrough, Issue 40, Spring 1995, p. 95, Hionis Taxidermy Wholesale Supplies, "Shaving Machine".

*Primary Examiner*—Michael A. Neas
*Attorney, Agent, or Firm*—John F. Sieberth

[57] ABSTRACT

The tool includes a linear housing, a thin circular fleshing blade with a cutting edge around its perimeter, and a guard member. The housing encompasses an air-driven or electric motor and serves as a handle. A rotary drive shaft projects at an angle from an end of the handle, and the free end of the drive shaft is equipped to have the blade mounted thereon. The guard member is mountable on the housing to cover a substantial portion of the blade. The angular displacement of the drive shaft and blade from the handle enables the user to conduct a fleshing operation with a backhand stroke that is easier to control than a forward thrust motion.

14 Claims, 7 Drawing Sheets

PORTABLE HAND-HELD FLESHING TOOL

TECHNICAL FIELD

This invention relates to improvements in the art of fleshing tool devices. More particularly, this invention relates to improvements in portable hand-held fleshing tools.

BACKGROUND

The current state of the art in portable hand-held fleshing tools is perhaps best illustrated by U.S. Pat. No. 4,993,243 to Dale E. Guinn, all disclosure of which is incorporated herein by reference. Distinctions between small, portable fleshing tools and large stationary fleshing machines, and advantages of the former over the latter, are well-stated in that patent.

Despite the advantages of the device described in the Guinn patent, the device is somewhat awkward to use, is not well-suited for use in fleshing both animal pelts and fish for mounting purposes, and because of the configuration of the fleshing tool, is more complex and expensive than would be desired.

SUMMARY OF THE INVENTION

This invention provides portable hand-held fleshing tools that are free from the foregoing limitations while at the same time retaining, and at least in some cases further improving upon, the advantageous features of the fleshing tool of the Guinn patent. In particular, as compared to the objects of the Guinn patent, and without in any way denigrating the advance the art afforded by that invention, this invention enables the provision of fleshing tool devices that:

1) are simpler in construction, easier to use, and less expensive;
2) are more lightweight, equally portable, and more efficient to use in fleshing various areas of a pelt;
3) are more quickly and more easily disassembled for cleaning, and simpler to assemble;
4) require no adjustment for depth of cut; and
5) are easily held and more readily controlled by one hand.

These and other advantageous features are made possible by providing, in accordance with one of the embodiments of this invention, a portable, hand-held fleshing tool which comprises:

a) a housing encompassing a source of rotary power and comprising a substantially linear handle portion having a rotary drive shaft projecting and disposed at an angle from an end portion thereof, the drive shaft having blade mounting means proximate the projecting end portion thereof;

b) a thin, circular fleshing blade mountable on the drive shaft, the blade having a cutting edge portion around the periphery thereof;

c) a guard member mountable on said housing to cover a substantial portion of the fleshing blade.

Generally speaking, the angular displacement between the longitudinal axis of the handle portion of the device and the axis rotary drive shaft (referred to hereinafter as angle $\alpha$) is typically between about 15° and about 120° and preferably between about 45° and about 100° . Most preferably the drive shaft projects at an angle of substantially 90° from the longitudinal axis of the handle portion. The blade is detachably mountable on the rotary drive shaft such that the plane of the blade is perpendicular to the axis of the drive shaft.

One of the great advantages of the fleshing tools of this invention is that the angular projection of the drive shaft from the handle portion enables the user to grasp and use the tool with essentially the same backhand grip and motion as knives are generally used in the art of taxidermy. In other words in normal use the handle portion of the fleshing tool of this invention is gripped and moved away from the user with the user's forearm bent across the front of the user's body, somewhat akin to the motion employed when whittling a stick with a knife. In contrast, the motion employed with a fleshing tool in which the drive shaft and handle are axially aligned is akin to the motion of a piston in a cylinder, and thus is more awkward and harder to control when doing delicate cutting work with the tool. Gouging can occur more readily in such a case.

Another advantage of this invention is that the angular projection of the drive shaft from the handle enhances the safety of the fleshing operation since the normal cutting stroke of the tool is, as noted above, the backhand stroke in a direction away from the user's body.

In one particularly preferred embodiment the blade is configured such that when mounted on the drive shaft the cutting edge of the blade projects forwardly from the drive shaft substantially coaxially relative to the axis of the blade and the drive shaft. In this embodiment the cutting edge is most preferably a continuous circular edge (e.g., the edge is not serrated) as this configuration provides excellent results when the tool is used for a wide variety of fleshing operations. This blade construction coupled with the angular displacement of the drive shaft from the handle further contributes to the safety of the tool during use since the sharp cutting edge of the blade faces away from the user at all times while the tool is in the normal backhand grip referred to above.

In another preferred embodiment the source of rotary power is an air-driven motor. In still another preferred embodiment the guard member is substantially transparent and most preferably is thin-walled and fabricated from a lightweight vacuum-formable substantially transparent plastic material. A further embodiment is a method of fleshing an animal or fish skin by use of a tool of this invention employing backhand fleshing strokes as above described.

Yet another embodiment is a thin, circular fleshing blade mountable on the drive shaft, the blade having a flexible cutting edge portion around the periphery thereof whereby the cutting edge can be flexed into desired cutting position at the zone of contact with the object being fleshed. Such blades can have a continuous circular cutting edge portion or a discontinuous, serrated-type circular cutting edge portion, and the blades can be configured such that the cutting edge portion of the blade when not in use differs from blade to blade. For example, in one blade configuration the cutting edge portion when not in use projects in a plane that is substantially perpendicular to the axis of the blade. In this case, during use the cutting edge can be flexed into various positions by altering the position and orientation of the handle relative to the surface being fleshed. In another configuration the cutting edge portion when not in use projects substantially coaxially relative to the axis of the blade, and here the cutting edge portion can flex and remain in a surface-parallel cutting position even though the position and orientation of the handle relative to the surface being fleshed is changed, intentionally or otherwise, during a fleshing operation. In other individual configurations the flexible cutting edge portion can be disposed when not in use to project at any selected angle ranging between zero and 90° relative to the plane occupied by the blade.

These and other embodiments and features of this invention will become still further apparent from the ensuing description, the appended claims, and the accompanying drawings.

BRIEF DESCRIPTION OF THE DRAWINGS

In the figures, like parts are identified by like numerals among the various views given in the drawings.

FURTHER DETAILED DESCRIPTION OF THE INVENTION

Figure 1:
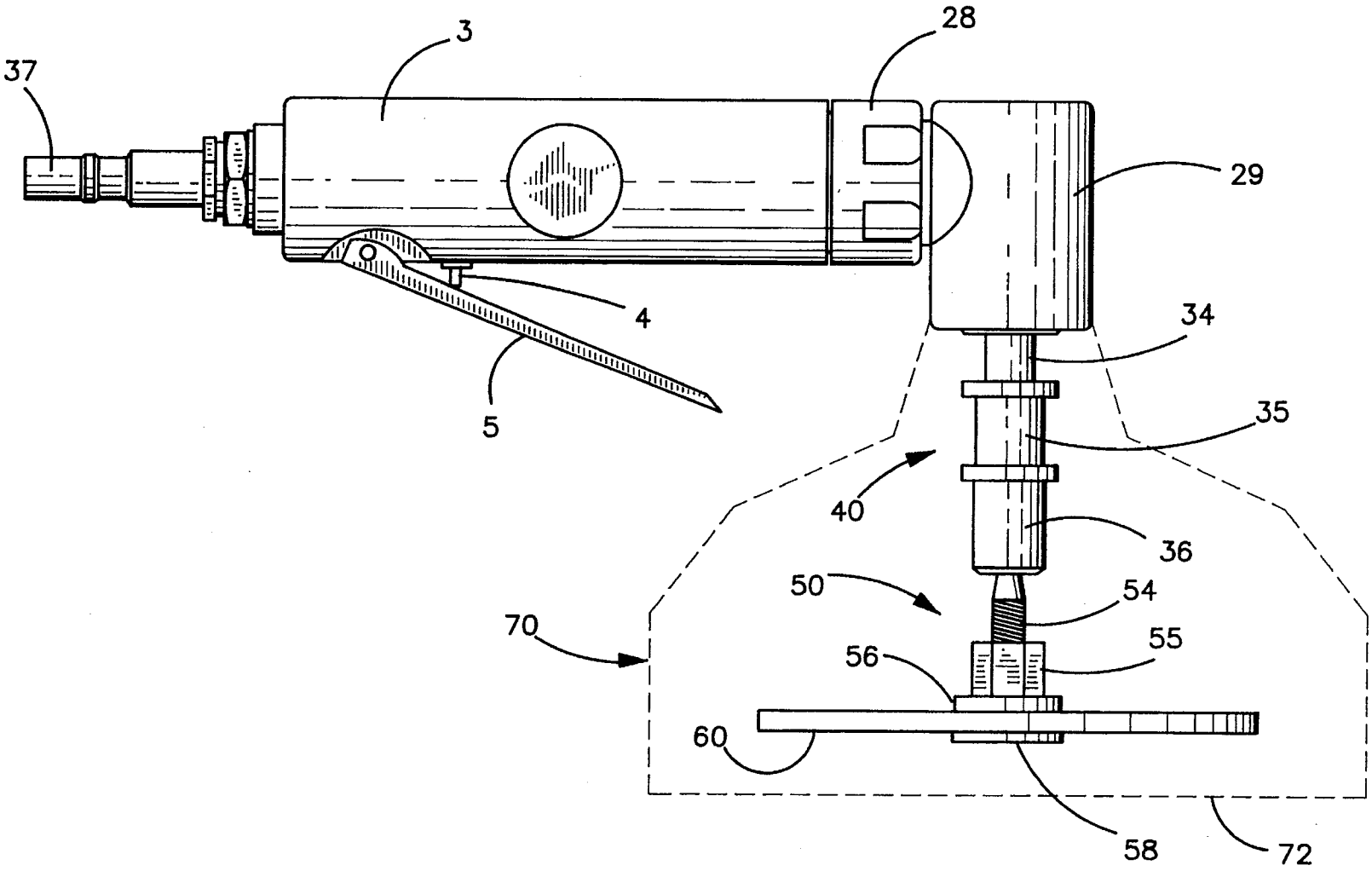
FIG. 1 is a plan view of a preferred air-driven fleshing tool of this invention.
Figure 2:
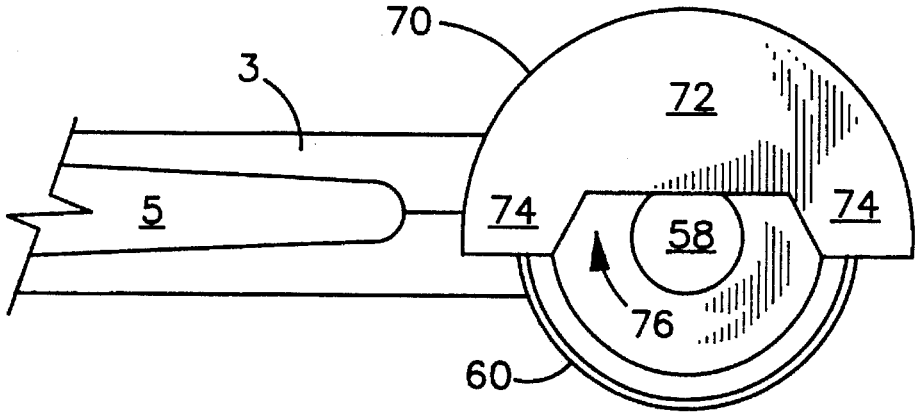
FIG. 2 is a fragmentary frontal view of the tool of FIG. 1 looking toward the front face of the cutting blade.

In a preferred form as depicted in FIGS. 1 and 2, the tool utilizes an air-driven motor rated at 25,000 rpm by the manufacturer, and available from Enco Manufacturing Company, 2920 Redhill Avenue, Costa Mesa, Calif. 92626 as Right Angle Die Grinder, Stock Number 801-1690. External parts of this particular motor include motor housing 3 which serves as the handle portion of the fleshing tool, angle housing 29 disposed from an end of housing 3 at a 90° angle from the axis of housing 3, pin 4, lever 5, air hose fitting 37 and rotary drive shaft 40 composed inter alia of spindle 34 and shaft connection means comprising a shaft-receiving collet 35 (not seen in FIGS. 1 and 2, but shown in FIG. 5) and collet nut 36 threadably mounted on spindle 34. Shaft 40 is also disposed from an end of housing 3 at a 90° angle from the axis of housing 3. With a hose (not shown) in place on fitting 37 for delivering compressed air (or like non-toxic gas) from tank or other suitable source, manual depression of lever 5 depresses pin 4 so that the compressed air enters the motor and causes rotation of the motor which in turn, through appropriate bevel gearing such as referred to hereinafter, causes rotation of shaft 40. The extent to which lever 5 and pin 4 are depressed governs the speed at which the motor and shaft 40 rotate. Thus the greater the extent of depression, the higher the rotational speed of the motor and shaft 40. Typically a tool of this invention with a motor such as the above is operated at a speed in the range of about 100 to about 500 rpm. However higher and lower speeds are can be used whenever deemed necessary or desirable. It will be appreciated that other air-driven motors can be used in the production of the fleshing tools of this invention. Likewise electric motors can be used for this purpose.

Figure 3:
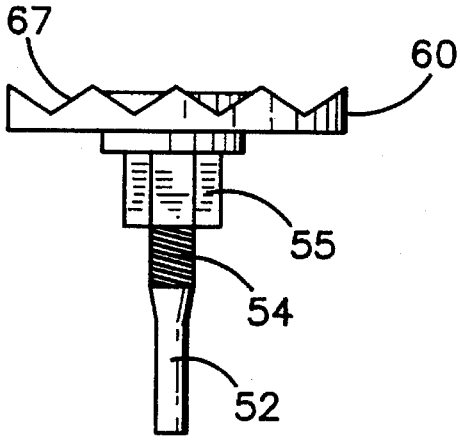
FIG. 3 is a side view of a serrated blade of this invention.
Figure 4:
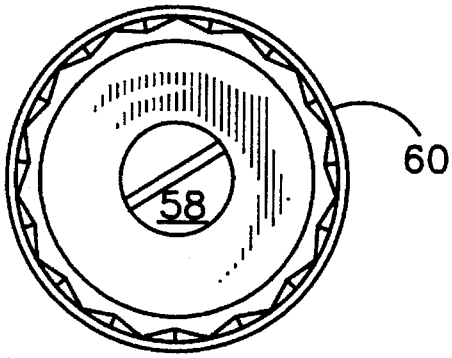
FIG. 4 is a front view of the blade of FIG. 3.
Figure 6:
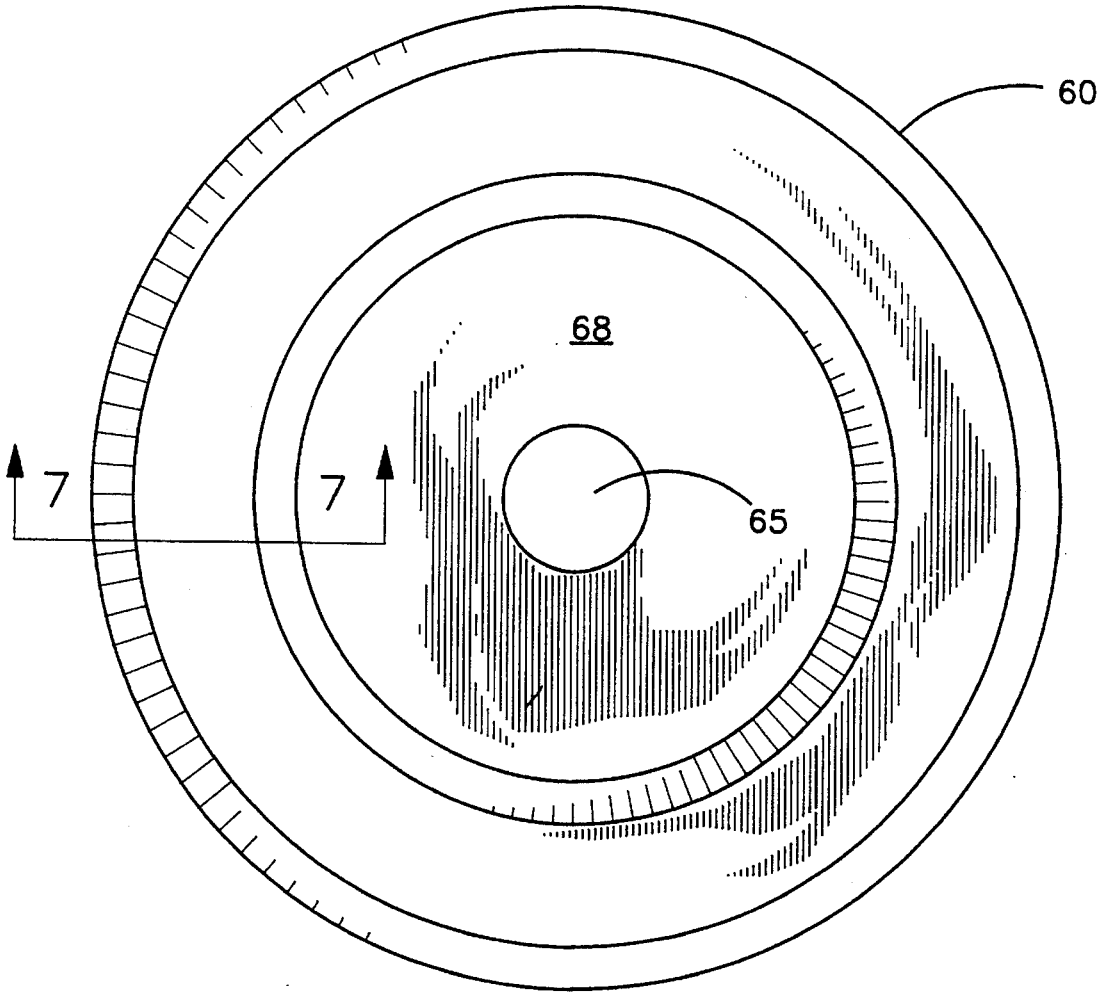
FIG. 6 is a front view of a preferred non-serrated blade of a fleshing tool of this invention.

The shaft connection means comprising spindle 34, collet 35 and collet nut 36 enable blade connector 50 to be detachably attached to shaft 40 so that these parts are all rotated in unison by the motor. As best seen in FIGS. 3 and 4, blade connector 50 in the preferred form depicted comprises shaft 52, threaded shank portion 54, nut 55, washer 56 and flanged head or outer end portion 58. Shaft 52 is sized to be received by collet 35 and secured therein by the threadable connection of collet nut 36 onto spindle 34 thereby establishing the detachable attachment of blade connector 50 to shaft 40. As seen in FIG. 6, circular cutting blade 60 has at its center an aperture 65. This aperture is sized to slidably fit over threaded shank portion 54 whereby, as indicated in FIG. 3, when nut 55 is tightened on shank portion 54, blade 60 is tightly secured in place between washer 56 and flanged head portion 58. Thus rotation of the motor causes rotation of the secured blade.

Guard member 70 is mountable on the tool in any suitable fashion so that the guard member covers a substantial portion of fleshing blade 60. In one preferred form, member 70 is shaped to fit over the top of and snap onto both cap 28 and angle housing 29 so that the generally semi-circular, cylindrical blade-covering portion of member 70 remains in place at all times during use of the fleshing tool. It is preferred to configure member 70 with edge cover portions 74,74 that extend downwardly so that member 70 provides blade coverage subtending an arc of at least about 180° up to about 220° of the upper perimeter of blade 60, and to configure the front wall 72 of member 70 with an upward arch-like recess 76 to provide a headspace extending upwardly above the axis of rotation of blade 60 and transversely by a linear distance equivalent to from about 50 to about 90% of the diameter of blade 60. Among the advantages of providing suitably shaped and configured snap-on guard members 70 are the following:

a) the snap-on guard members can be provided as interchangeable sets of two or more members sized to cover blades of different diameters;

b) the snap-on guard members can be easily applied and removed from the fleshing tool, yet they remain in place during the fleshing operation;

c) the snap-on guard members can be snapped onto cap 28 and angle housing 29 with the handle projecting either to the right or to the left of the user so that the tool can be safely used by both righthanded persons and lefthanded persons;

d) the snap-on guard members are light in weight; and e) the snap-on guard members are easily manufactured at low cost from readily available plastic materials, most preferably, thermoformable plastic materials.

In particularly preferred embodiments, guard members 70 are fabricated from transparent plastic materials so that the excessive accumulation of flesh under the guard member can be perceived visually during a fleshing operation.

Figure 8A:
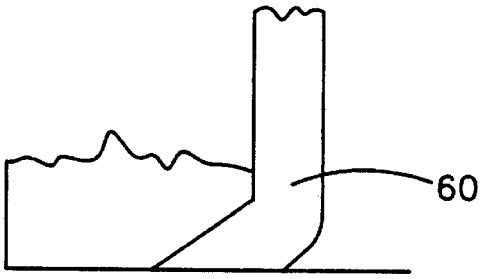
FIGS. 8A and 8B are a schematic line drawings illustrating the flexing of a preferred flexible serrated blade of this invention during use.
Figure 8B:
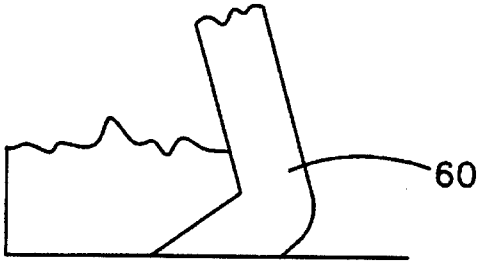

FIGS. 3 and 4 depict a serrated blade 60 of a fleshing tool of this invention. The blade can be made of steel or other rigid metal capable a holding sharp cutting edges on the serrations 67. In a preferred embodiment, the serrated blade has flexible serrations and thus the blade is most preferably fabricated from a hard rubber or plastic material having the requisite physical properties. The material used should have sufficient stiffness for the serrations or teeth to maintain flesh cutting action during continuous rotary contact with the substrate being fleshed, while at the same time having sufficient flexibility for the serrations or teeth to be flexed forwardly and inwardly toward the axis of rotation during rotation necessitated by intentional or unintentional alteration of the orientation of the fleshing tool and possible application of moderate downward manual pressure to the handle of fleshing tool. Note FIGS. 8A and 8B in this connection. Suitable plastic materials include low and medium density polyethylene, as well as grades of polypropylene and filled rubber or other filled elastomers having a comparable balance between flexibility and stiffness.

Figure 5:
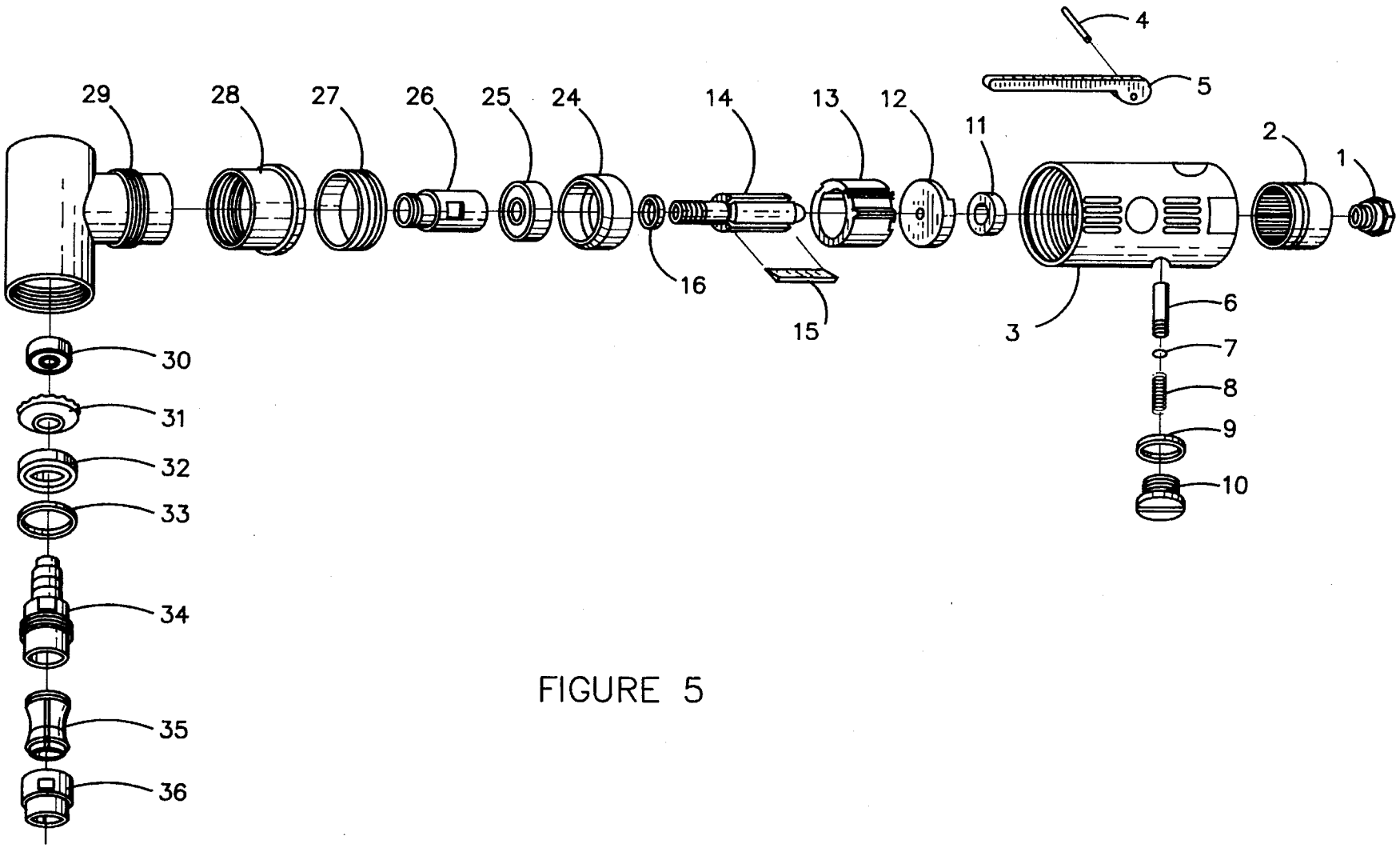
FIG. 5 is an exploded view of a housing forming the handle portion of the device and of an air-driven rotary drive shaft projecting and disposed at an angle from an end portion thereof, and illustrating typical internal and external parts thereof.

FIG. 5 illustrates the internal and external parts of a typical air-driven motor and angularly disposed drive shaft suitable for use in the fleshing tools of this invention. It will be appreciated that this invention is not intended to be limited to use of a device of this particular configuration and construction as the motor can be operated by compressed air or it can be an electric motor, and the component parts can be of any suitable design, configuration and arrangement as long as the drive shaft projects at a suitable angle from the axis of the handle and the motor delivers sufficient power to suitably drive the cutting blade in a fleshing operation.

In FIG. 5 the parts of the device as depicted by the manufacturer include hose adapter 1, exhaust sleeve 2, motor housing or handle portion 3, pin 4, lever 5, valve pin 6, valve 7, spring 8, O-ring 9, valve screw 10, ball bearing 11, rear plate 12, cylinder 13, rotor 14, rotor blade 15, bearing spacer 16, front plate 24, ball bearing 25, bevel gear 26, cap lock 27, cap 28, angle housing 29, ball bearing 30, gear 31, ball bearing 32, clamp nut 33, spindle 34, collet 35, and collet nut 36. In essence, as handle 5 is depressed to open valve 7, the compressed air received through hose adapter i causes rotor 14 to rotated. This rotation in turn is transmitted angularly-displaced spindle 34 by means of bevel gear 26 interacting with gear 31. Thus the angularly-projecting drive shaft of the device is caused to rotate.

Figure 7:
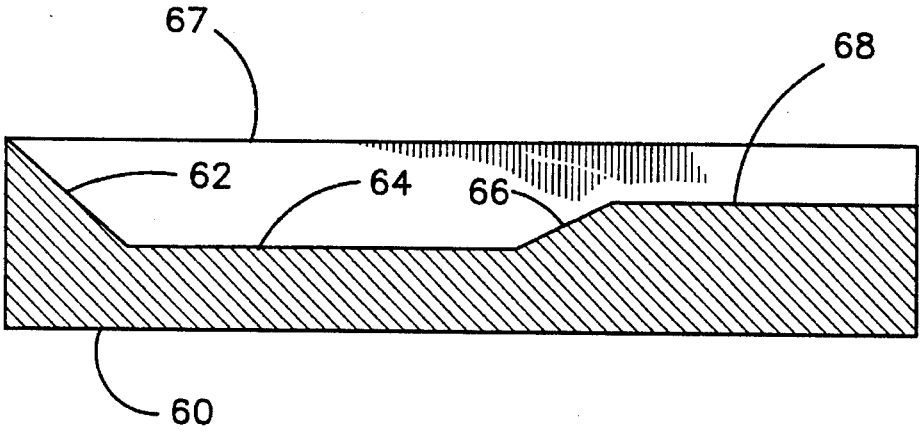
FIG. 7 is a fragmentary section view taken along line 7,7 of FIG. 6.

FIGS. 6 and 7 illustrate the configuration of preferred non-serrated cutting blades 60 of the fleshing tools of this invention. Such blades are preferably fabricated from steel or other metal having the ability to accept and maintain a sharp continuous cutting edge. It will be noted from FIG. 7 that the cutting edge portion has throughout the full 360° a downwardly ramped interior side 62, a depressed flat land segment 64 immediately adjacent the inner edge of side 62, and an upwardly ramped section 66 on the inner edge of segment 64. The inner edge of section 66 defines the outer edge of a flat circular interior face 68 of the blade. As depicted in FIG. 7, the plane of face 68 is above the plane of flat land segment 64. For best results, throughout the 360° of the blade, the cutting edge 67, the flat land segment 64 and the interior face 68 of the blade occupy three different parallel planes, and the plane occupied by interior face 68 of the blade is between the other two parallel planes.

Figure 9:
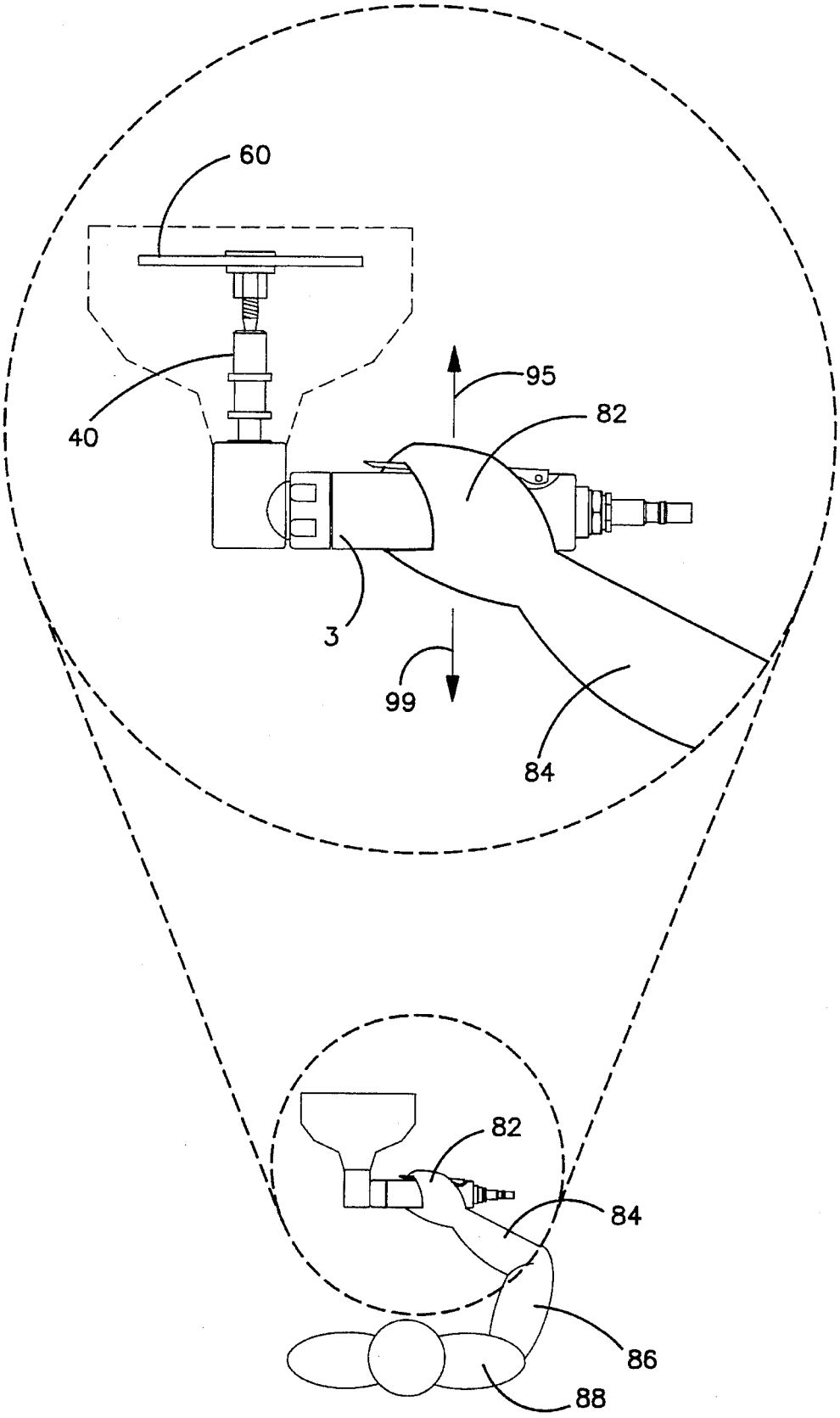
FIG. 9 is a partial schematic drawing illustrating the manner in which backhand fleshing strokes are made possible for use in conducting a fleshing operation employing a fleshing tool of this invention.

As can be appreciated from FIG. 9, in conducting a fleshing operation employing a fleshing tool of this invention, the angular projection of the rotary drive shaft 40 of the tool relative to the axis of the handle 3 of the tool makes it possible for the user to grasp the handle with the hand, represented by circle 82, disposed as in a fist with the palm of the hand facing down, so that handle 3 is more or less centrally positioned out in front of and transverse to the user's body represented by 88. Thus with the upper arm, represented by 86, extending forwardly (and usually downwardly as well) and the forearm, represented by 84, in an angular position such as illustrated, extension of the forearm in a generally forward direction causes the rotating cutting blade 60 to be moved in forward cutting strokes as represented by arrow 95 (sometimes referred to herein as backhand strokes) and in rearward repositioning strokes as represented by arrow 99. FIG. 9 schematically depicts the general positioning for a righthanded user; however the same considerations apply when the handle projects toward the left and the left arm and hand are used in an analogous fashion.

It will be seen that the cutting blade 60 can be reversed such that its cutting edge 67 faces toward the user. In such case the same backhand strokes can be used except that the cutting stroke would be in the direction of arrow 99 of FIG. 9, and the repositioning stroke would be in the direction of arrow 95 of FIG. 9. In some situations this type of cutting stroke can be advantageous.

Figure 10A:
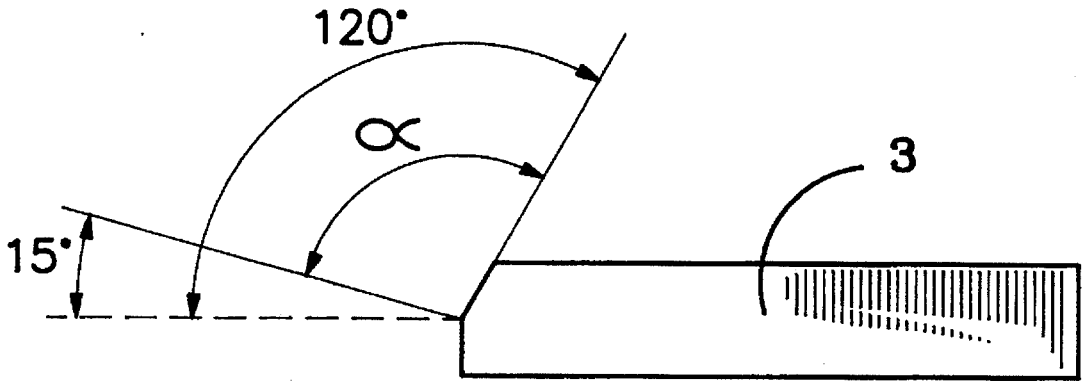
FIG. 10A and 10B are schematic line drawings depicting the ranges for angle α, that is, the angular displacement between the longitudinal axis of the handle portion of the device and the axis of the rotary drive shaft, FIG. 10A showing a typical range and FIG. 10B showing a preferred range.
Figure 10B:
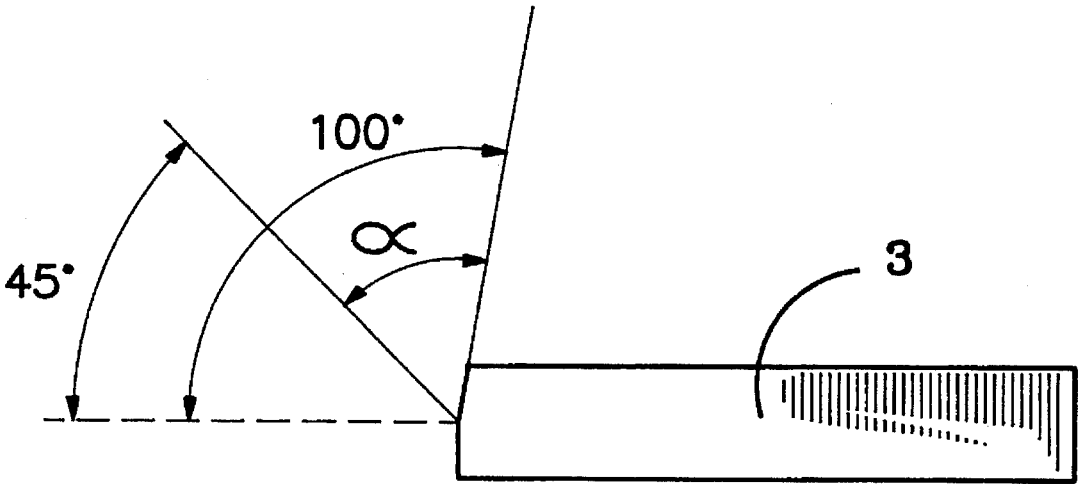

As noted above and as schematically depicted in FIGS. 10A and 10B, the ranges for angle $\alpha$, that is, the angular displacement of the axis of the rotary drive shaft from the longitudinal axis of the handle portion of the device are typically between about 15° and about 120° (FIG. 10A) and preferably between about 45° and about 100° (FIG. 10B). Most preferably the drive shaft projects at an angle of 90° from the longitudinal axis of the handle portion.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

What is claimed is:

1. A portable, hand-held fleshing tool which comprises:

a) a housing encompassing a source of rotary power, the housing comprising a substantially linear handle portion having a rotary drive shaft projecting and disposed at an angle from an end portion thereof, the drive shaft having blade mounting means proximate the projecting end portion thereof;

b) a thin, circular fleshing blade mountable on the drive shaft, the blade having a cutting edge portion around the periphery thereof; and c) a guard member mountable on said housing to cover a substantial portion of the fleshing blade;

wherein throughout the full 360° of the blade, the cutting edge portion of the blade projects substantially coaxially relative to the axis of the blade, and wherein throughout the full 360° of the blade, the cutting edge portion has a downwardly ramped interior side, a depressed flat land segment immediately adjacent the inner edge of said interior side, and an upwardly ramped section on the inner edge of said segment, the inner edge of said section defining the outer edge of a flat circular interior face of the blade.

2. A tool of claim 1 wherein said angle is substantially a 90-degree angle.

3. A tool of claim 1 wherein the cutting edge of the blade is in the form of a continuous circle.

4. A tool of claim 1 wherein the cutting edge portion of the blade has a serrated circular cutting edge.

5. A tool of claim 4 wherein at least the cutting edge portion of the blade has sufficient stiffness for the serrations or teeth to maintain flesh cutting action during continuous rotary contact with the substrate being fleshed, while at the same time having sufficient flexibility for the serrations or teeth to be flexed forwardly and inwardly toward the axis of rotation during rotation necessitated by intentional or unintentional alteration of the orientation of the fleshing tool and possible application of moderate downward manual pressure to the handle of fleshing tool during use in fleshing.

6. A tool of claim 1 wherein the cutting edge of the blade, said flat land segment and said interior face of the blade occupy three different parallel planes and wherein the plane occupied by said interior face of the blade is between the other two parallel planes.

7. A tool of claim 1 wherein said source of rotary power is an air-driven motor.

8. A tool of claim 1 wherein said guard member is substantially transparent.

9. A tool of claim 1 wherein said angle is substantially a 90-degree angle and wherein said guard member is mountable on said housing by a snap fit.

10. A tool of claim 9 wherein said guard member is thin-walled and fabricated from a lightweight vacuum-formable substantially transparent plastic material.

11. A portable, hand-held fleshing tool which comprises:

a) a substantially linear handle portion encompassing a source of rotary power about an axis, and an angle housing portion angularly disposed at an end of the handle portion and encompassing at least a portion of a rotary drive shaft assembly rotatable by said source of rotary power;

b) a thin, circular fleshing blade detachably connected to be rotated by the rotary drive shaft assembly, the blade having a cutting edge portion including a cutting edge around the periphery thereof; and c) a guard member shaped, sized and configured to snap onto a portion of said linear handle portion and at least a portion of said angle housing so that said guard member covers a substantial portion of the fleshing blade;

wherein said angularly disposed angle housing portion is disposed at substantially a 90-degree angle relative to the axis of the source of rotary power encompassed by the linear handle portion; wherein the cutting edge portion of the blade projects forwardly from said angularly disposed angle housing portion coaxially relative to the axis of the blade; wherein the cutting edge is in the form of a continuous circle; wherein throughout the full 360° of the blade the cutting edge portion has a downwardly ramped interior side, a depressed flat land segment immediately adjacent the inner edge of said interior side, and an upwardly ramped section on the inner edge of said segment, the inner edge of said section defining the outer edge of a flat circular interior face of the blade; and wherein the cutting edge of the blade said flat land segment and said interior face of the blade occupy three different parallel planes; and wherein the plane occupied by said interior face of the blade is between the other two parallel planes.

12. A tool of claim 11 wherein said source of rotary power is an air-driven motor and wherein said guard member is thin-walled and fabricated from a lightweight vacuum-formable substantially transparent plastic material.

13. A portable, hand-held fleshing tool which comprises:

a) a housing encompassing a source of rotary power, the housing comprising a substantially linear handle portion having a rotary drive shaft projecting and disposed at an angle from an end portion thereof, the drive shaft having blade mounting means proximate the projecting end portion thereof;

b) a thin, circular serrated fleshing blade mountable on the drive shaft, the blade having a cutting edge portion around the periphery thereof; and c) a guard member mountable on said housing to cover a substantial portion of the fleshing blade;

wherein the cutting edge portion of the blade projects forwardly from said angularly disposed angle housing portion coaxially relative to the axis of the blade and wherein at least the cutting edge portion of the blade has sufficient stiffness for the serrations or teeth to maintain flesh cutting action during continuous rotary contact with the substrate being fleshed, while at the same time having sufficient flexibility for the serrations or teeth to be flexed forwardly and inwardly toward the axis of rotation during rotation necessitated by intentional or unintentional alteration of the orientation of the fleshing tool and possible application of moderate downward manual pressure to the handle of fleshing tool during use in fleshing.

14. A tool of claim 13 wherein said angle is substantially a 90-degree angle.

* * * * *